US007850023B2

(12) United States Patent
Silveria

(10) Patent No.: US 7,850,023 B2
(45) Date of Patent: Dec. 14, 2010

(54) MODULAR DEVICE FOR DISPLAYING AND MERCHANDISING RETAIL ARTICLES

(75) Inventor: Edison Rey Silveria, Sao Paulo (BR)

(73) Assignee: Cadbury Adams USA LLC, Parsippany, NJ (US)

( * ) Notice: Subject to any disclaimer, the term of this patent is extended or adjusted under 35 U.S.C. 154(b) by 156 days.

(21) Appl. No.: 11/717,268

(22) Filed: Mar. 13, 2007

(65) Prior Publication Data

US 2007/0257053 A1 Nov. 8, 2007

Related U.S. Application Data

(60) Provisional application No. 60/797,429, filed on May 3, 2006.

(51) Int. Cl.
*A47B 47/00* (2006.01)
*A47B 43/00* (2006.01)
*A47B 57/00* (2006.01)

(52) U.S. Cl. ..... 211/194; 248/220.21; 248/224.7; 248/225.11; 248/159; 248/27.1; 211/188; 211/85.4; 211/49.1; 211/85.26; 211/133.1; 211/126.2; 211/126.12; 211/123; 312/117; 312/107; 312/108

(58) Field of Classification Search ..... 248/220.21, 248/224.7, 225.11, 27.1; 211/85.4, 49.1, 211/85.26, 133.1, 194, 126.2, 126.12, 188; 312/117, 107, 108
See application file for complete search history.

(56) References Cited

U.S. PATENT DOCUMENTS 1,382,092 A 6/1921 Kilmer
1,568,389 A 1/1926 Wilson
1,628,439 A 5/1927 Staubly
1,663,088 A 5/1928 Matheson
1,676,356 A 7/1928 Sapinsley
1,695,463 A 12/1928 Lipschutz
1,913,231 A 6/1933 Carlstedt et al.
1,980,819 A 11/1934 Nelson
1,999,021 A 4/1935 Marsh
D203,696 S 2/1966 Page
3,309,206 A 3/1967 Daniels
3,401,993 A * 9/1968 Fenkel ..... 312/111
3,552,817 A * 1/1971 Marcolongo ..... 312/107
3,851,936 A * 12/1974 Muller ..... 312/108
3,926,314 A 12/1975 Dogliotti
3,993,196 A 11/1976 Immordino
4,014,437 A 3/1977 Rumble et al.
4,030,608 A 6/1977 Howard
4,144,662 A 3/1979 Drexler
4,243,279 A * 1/1981 Ackeret ..... 312/107
4,550,838 A 11/1985 Nathan et al.
4,767,022 A 8/1988 Oldorf (Continued)

*Primary Examiner*—Anita M King
*Assistant Examiner*—Nkeisha J Smith
(74) *Attorney, Agent, or Firm*—Hoffman & Baron, LLP

(57) ABSTRACT

A device provides for displaying and dispensing retail articles. The device includes a plurality of product support modules that are detachably coupled to one another. Each support module includes a bottom mating portion and a top mating portion, each of which may be operatively coupled to a top mating portion and a bottom mating portion of another support module, respectively. Each support module also include sidewalls that may be operatively coupled to sidewalls of another support module. All of the product support modules of the present invention have a substantially similar profile.

9 Claims, 12 Drawing Sheets

U.S. PATENT DOCUMENTS 4,815,604 A * 3/1989 O'Neil et al. ..... 206/518
4,881,787 A 11/1989 King et al.
D316,638 S 5/1991 Oldorf
5,255,801 A 10/1993 Berger
5,271,515 A * 12/1993 Berkheimer et al. ..... 220/4.27
5,328,258 A 7/1994 Scalise
5,370,220 A 12/1994 Wang
5,590,813 A 1/1997 Abramczyk
5,836,661 A 11/1998 Oldorf
5,848,709 A * 12/1998 Gelphman et al. ..... 211/40
5,988,410 A 11/1999 Mandle
6,155,435 A * 12/2000 Malik ..... 211/41.12
6,189,710 B1 2/2001 Mason
6,406,107 B1 6/2002 Franczak
6,523,706 B2 * 2/2003 Flores ..... 211/85.22
6,786,341 B2 9/2004 Stinnett et al.
6,955,268 B2 * 10/2005 Waldron ..... 211/51
7,350,648 B2 * 4/2008 Gerstner et al. ..... 211/87.01
7,617,941 B2 * 11/2009 Colin et al. ..... 211/59.2
2004/0217077 A1 11/2004 Gerstner et al.
2007/0187346 A1 * 8/2007 Markson et al. ..... 211/85.26

* cited by examiner

MODULAR DEVICE FOR DISPLAYING AND MERCHANDISING RETAIL ARTICLES

CROSS-REFERENCE TO RELATED APPLICATION

This application claims the benefit of U.S. Provisional Application No. 60/797,429 filed on May 3, 2006, entitled "MODULAR DEVICE FOR DISPLAYING AND MERCHANDISING RETAIL ARTICLES".

FIELD OF THE INVENTION

The present invention relates generally to a device which displays and dispenses retail articles. More particularly, the present invention relates to a modular display stand having provisions for displaying and dispensing a plurality of different retail articles, such as packages, which may contain confectionary products such as gum in the form of slabs, sticks, pellets or the like.

BACKGROUND OF THE INVENTION

The art has seen a wide variety of devices used to contain, dispense and display various articles of merchandise. Specifically, the art has seen a variety of devices used to display and dispense confectionary products such as candy and gum which may be located at the point of purchase typically adjacent the cash register at a retail store. Many of the display devices used at the point of purchase are designed to accommodate a single product. Such display devices are thereby dedicated to that product and may include advertising information related to the single product.

Various display devices are designed to contain and dispense a plurality of different products. These display devices may include plural compartments to store the different products. These display devices are usually cumbersome and difficult to use. Multi-compartment display devices are shown, for example, in U.S. Pat. Nos. 6,189,710 and 5,255,801.

Still other display devices are suitable for both retaining and dispensing an array of products. U.S. Pat. No. 5,370,220 shows such a display device. These products, however, are limited in the number and type of products that may be displayed and dispensed. Furthermore, the products themselves are hidden from view. This tends to detract from any advertising potential of the display device. Moreover, additional advertising and informational indicia must be placed on this display device which can result in the display device being dedicated to one type of product.

Therefore, there is a need for a display and dispensing device that can accommodate a varied number and type of products and which may be easily loaded and display in an attractive and informative manner a variety of products.

SUMMARY OF THE INVENTION

The present invention provides a device for displaying and dispensing retail articles. The device includes a plurality of product support modules that are detachably coupled to one another. Each support module includes a bottom mating portion and a top mating portion, each of which may be operatively coupled to a top mating portion and a bottom mating portion of another support module, respectively. Each support module also include sidewalls that may be operatively coupled to sidewalls of another support module. All of the product support modules of the present invention have a substantially similar profile.

A retail article is removably supported by each support module. In a preferred embodiment of the present invention, the coupling of support modules is designed to accommodate a varied array of products. In some embodiments, the support modules are made transparent permitting viewing of the articles and indicia contained thereon.

For example, according to one aspect, the device includes a plurality of product support modules detachably coupled to one another. Each of the support modules includes a top mating portion for insertion into a bottom mating portion of a support module and sidewalls being attachable to an adjacent sidewall of a support module. The plurality of product support modules have a substantially similar profile.

In some preferred embodiments, each support module is made from a transparent polymeric material to permit viewing of the articles and indicia contained in the support module.

Additional features and advantages will be readily apparent from the following detailed description, the accompanying drawings and the claims.

BRIEF DESCRIPTION OF THE DRAWINGS

Like reference symbols in the various drawings indicate like elements.

DETAILED DESCRIPTION OF THE PREFERRED EMBODIMENT

The present invention provides a modular display stand for displaying and dispensing a plurality of retail articles. The display stand may be used in a retail establishment at the point of purchase such as the cash register. The stand device includes a plurality of product support modules that can be detachably coupled to one another. In one preferred embodiment, each support module is formed to include a bottom mating portion and a top mating portion that can be detachably coupled to another support module. Each support module also includes sidewalls that can be detachably coupled to sidewalls of another support module. All of the product support modules of the present invention have a substantially similar profile and may be arranged to support any number of retail articles.

The present invention allows retail articles contained within each module to serve as an advertising medium as the articles may be viewed while arranged in the stand. Moreover, the support modules allow a plurality of different articles to be displayed and dispensed in a configurable structure.

In the present illustrative embodiment, the stand may be configured to support a plurality of packages which contain confectionary products such as gum which may take the form of pellets and slabs or the like. Moreover, the display and dispensing stand of the present invention may be configured in any number of configurations that support packages such as a blister package which supports gum pellets, a gum package which supports gum slabs, and miscellaneous unpackaged items such as loose hard candy.

Figure 1:
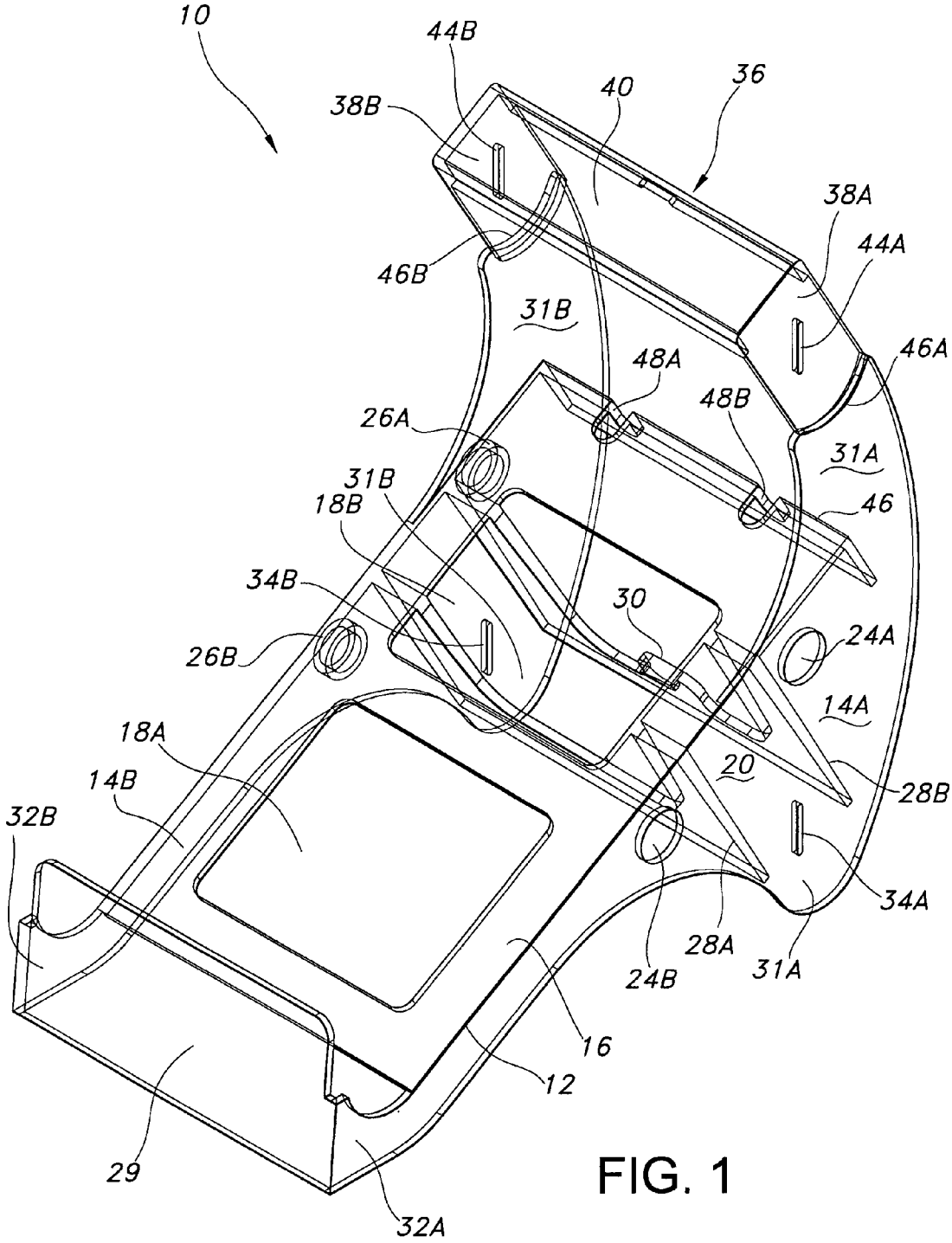
FIG. 1 is a perspective showing of a first product support module of the present invention.
Figure 2:
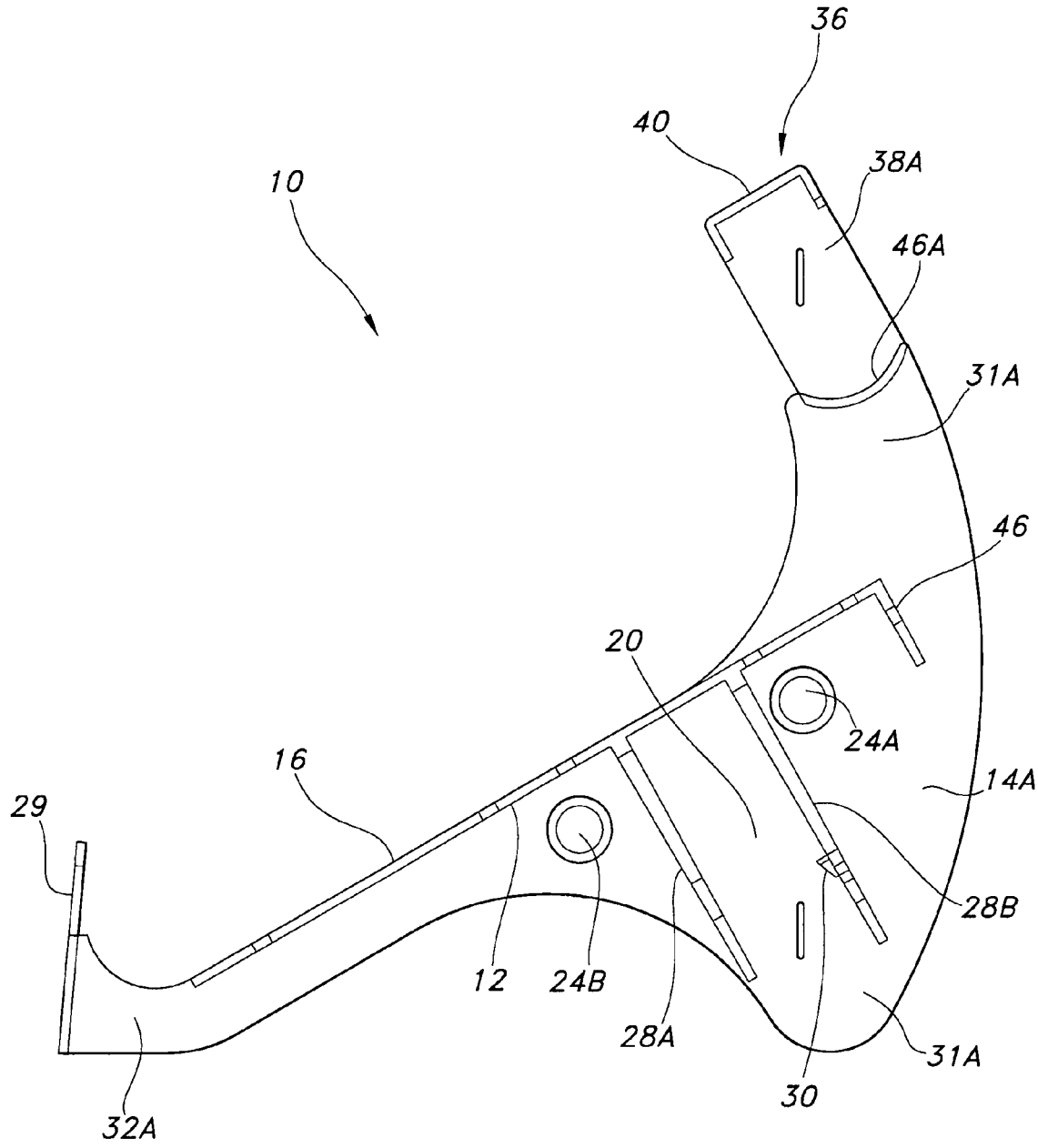
FIG. 2 is a side view of the first product support module of FIG. 1.

FIGS. 1 and 2 show a first support module 10 of the present invention. The support module 10 includes a frame 12 having a support surface 16, a rear back wall 46 and a plurality of bottom walls 28A, 28B. The support module 10 can be made from a variety of processes and materials, as for example, molded transparent polymeric material, stamped materials or combinations thereof.

The support surface 16 of the frame 12 provides support for packages which contain confectionary products. In one preferred embodiment, referring now to FIGS. 1 and 3, the support surface 16 is generally planar and may include a plurality of rectangular apertures 18A, 18B. The plurality of apertures 18A, 18B may provide material savings in forming the support surface 16, as well as provide ease of molding in forming the support surfaces.

Figure 3:
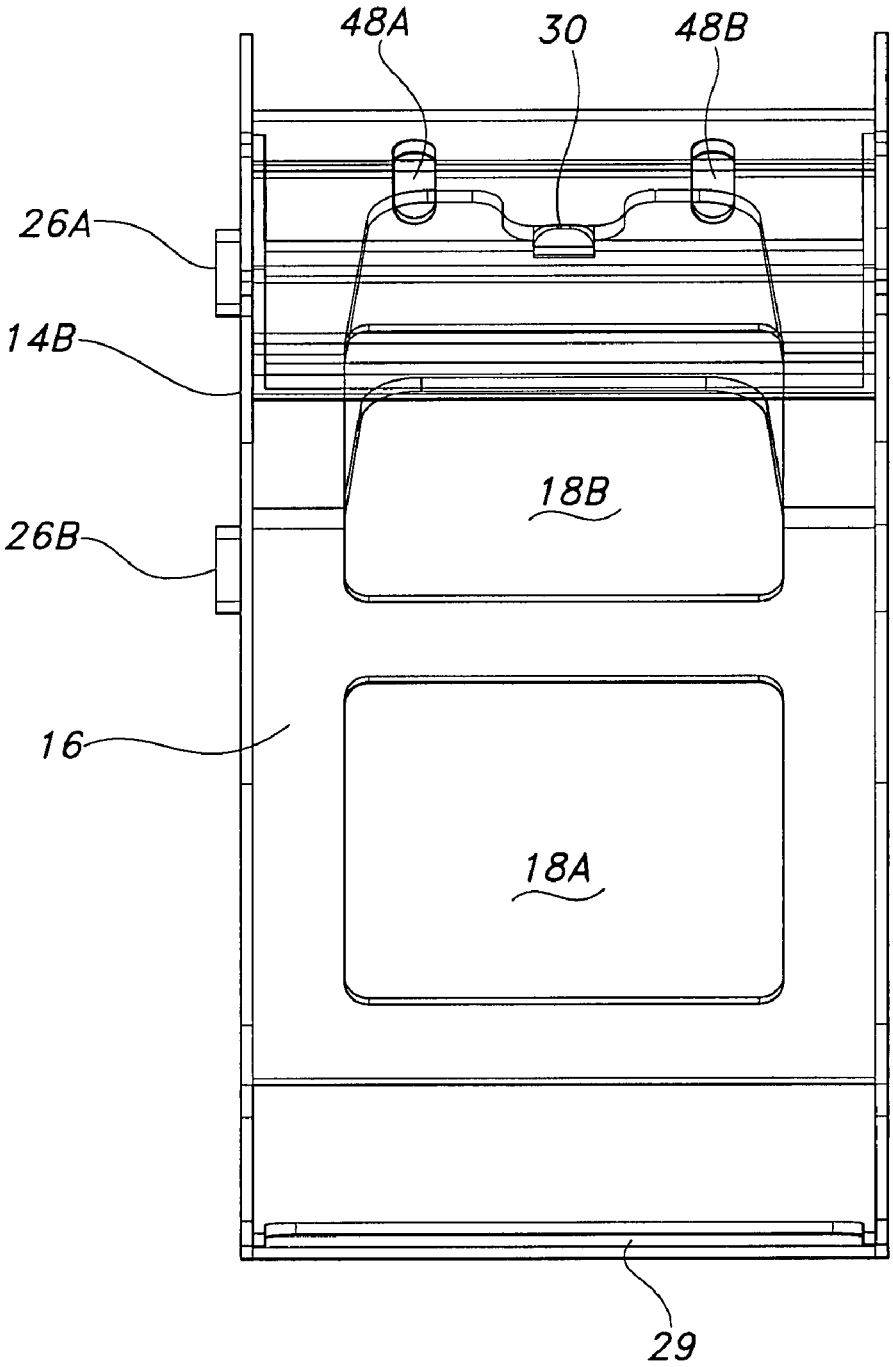
FIG. 3 is a top view of the first product support module of FIG. 1.

Referring again to FIGS. 1 and 2, the back wall 46 of the frame 12 is attached perpendicular to the support surface 16 and extends in a downward direction away from the support surface 16. In some preferred embodiments, the back wall 46 provides additional support for product packages. For example, as shown in FIGS. 1 and 3, the back wall 46 includes a plurality of support notches 48A, 48B that extend upward from the back wall and into the support surface 16. The support notches 48A, 48B may be used to further secure a product package to a rearward portion of the support surface 16.

As shown in FIGS. 1-3, a plurality of bottom walls 28A, 28B are provided that are attached perpendicular to the support surface 16 and extend in a downward direction away from the support surface 16 to form a bottom mating portion, such as a cavity 20. In one preferred embodiment, the cavity 20 formed is of dimensions suitable to securely receive a top mating portion of another support module. In one preferred embodiment, one of the bottom walls 28B includes a flexible locking mechanism 30, such as a tab, that is preferably of a thickness slightly greater than the sidewall 28B. The flexible locking mechanism 30 is used to detachably couple the top mating portion of another support module to the module 10. Details of coupling and detaching the top mating portion of one support module to another support module are discussed in further detail hereinbelow in connection with FIGS. 4 and 5.

The support module 10 of the present invention includes sidewalls 14A, 14B that can be made from a variety of processes and materials, as for example, molded transparent plastic. As shown in FIGS. 1 and 2, the sidewalls 14A, 14B support the frame 12 of the module 10 and may be formed as part of the frame 12 or may be separately made and attached to the frame 12. In one preferred embodiment, for example, the sidewalls 14A, 14B are attached to the frame 12, such that, the frame 12 is supported at approximately a thirty (30) degree angle in the support module 10. The sidewalls, however, are not limited to supporting the frame at a thirty (30) degree angle and may support the frame 12 at other advantageous angles in the support module 10.

The sidewalls 14A, 14B of the present invention include a back portion 31A, 31B having stoppers 46A, 46B that may be used to support coupled modules and a front portion 32A, 32B that is attached to a front wall 29. In one preferred embodiment, the front wall 29 is formed of transparent plastic to allow clear viewing of packages supported on the module 10. In other preferred embodiments, the front wall 29 allows indicia concerning packages being supported to be displayed.

As shown in FIG. 1, in one preferred embodiment, the back portion 31A, 31B of the sidewalls 14A, 14B include one or more oval apertures 34A, 34B that may be adapted to receive a fastener capable of securing the sidewalls 14A, 14B to a top mating portion of another support module.

The support module 10 includes a top mating portion 36 that may be detachably coupled to other product support modules. The top mating portion 36 includes a top wall 40 that is coupled to perpendicular top sidewalls 38A, 38B that extend in a downward direction away from the top wall 40. In one preferred embodiment, the top sidewalls 38A, 38B are attached to a top portion 46A, 46B of the sidewalls 14A,14B of the frame 12 using fasteners. In another preferred embodiment, the top sidewalls 14A,14B are molded onto an interior side of the top portion 46A,46B of the sidewalls 14A,14B. The top mating portion 36 of the support module 10 may be inserted into a cavity of another support module and thereby, be detachably coupled to another support module.

Figure 4:
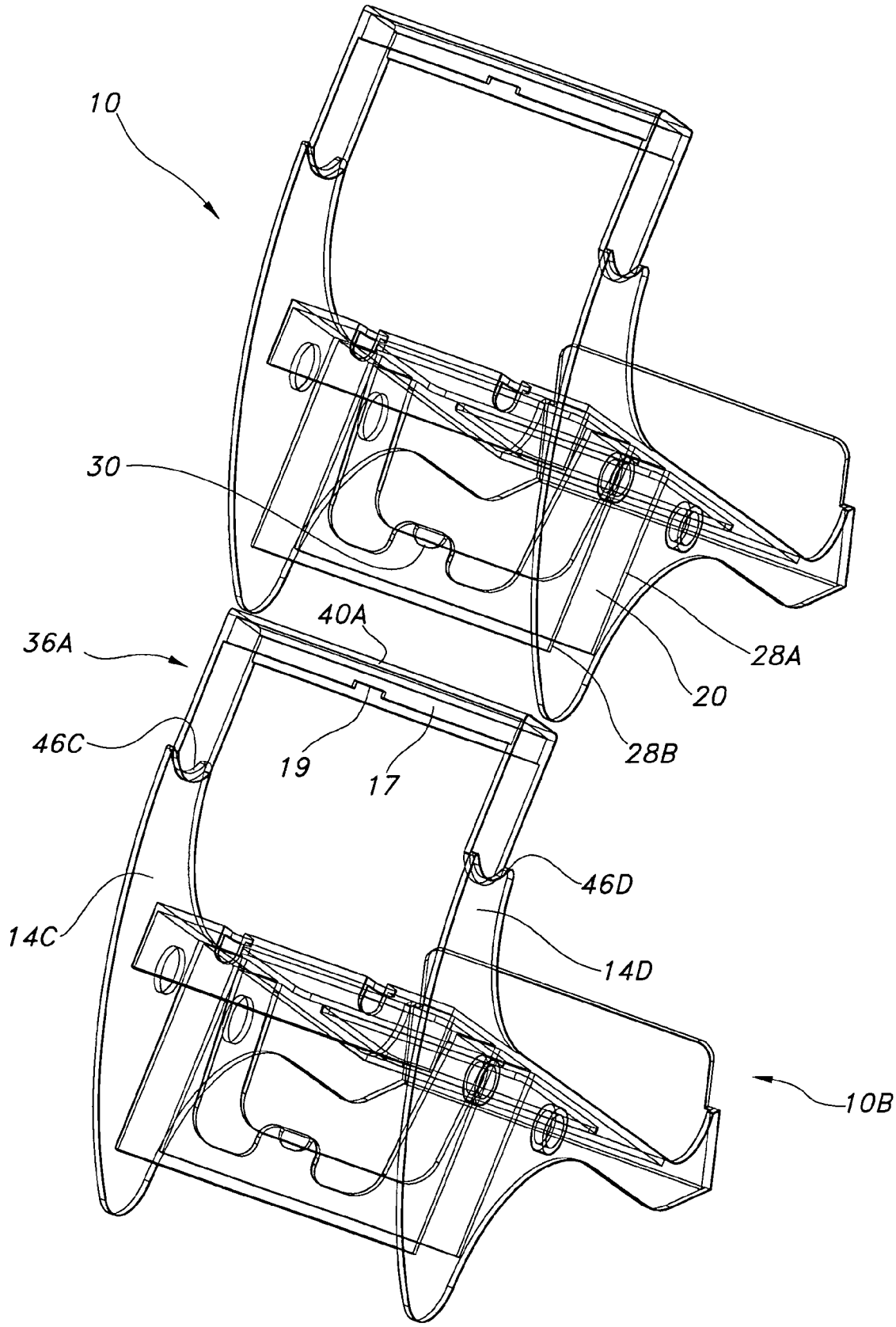
FIG. 4 is a perspective showing of a plurality of first product support modules coupled together.
Figure 5:
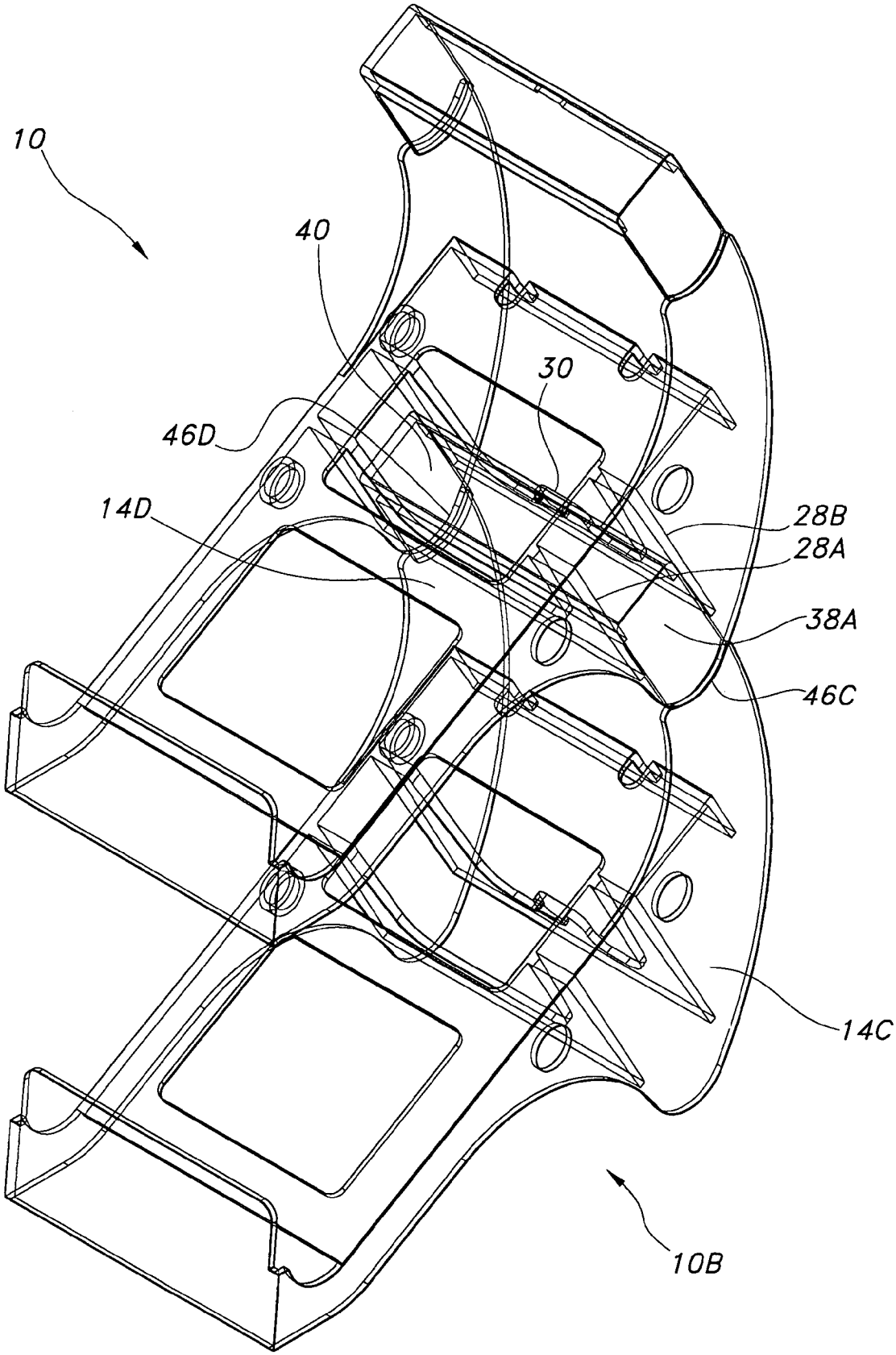
FIG. 5 is a rear view of the plurality of first product modules shown in FIG. 4.

Referring now to FIGS. 4 and 5, two support modules 10, 10B capable of being detachably coupled together are shown. A top mating portion 36A of a support module 10B is inserted into the cavity 20 of the module 10. As the top mating portion 36A is moved into the cavity 20 and toward the locking mechanism 30, the locking mechanism 30 of the support module 10 flexes away from a top wall 40A of the module 10B. Once the top wall 40A moves further into the cavity 20 and over the locking mechanism 30, the locking mechanism 30 flexes away from a back flange 17 attached to the top wall 40A and engages a notch 19 positioned on the back flange 17, thereby locking and detachably coupling the support modules 10, 10B vertically together. In one preferred embodiment, as shown in FIG. 5, the tops 46C, 46D of the sidewalls 14C, 14D may prevent further insertion of the top mating portion 36A into the cavity 20 and also may provide support for the support module 10. To detach the support modules 10, 10B, the lock mechanism 30 is flexed away from the back flange 17 and the top mating portion 36A is withdrawn from the cavity 20.

Referring again to FIG. 1, in one preferred embodiment, the top sidewalls 38A, 38B include top mating apertures 44A, 44B that may be used to further secure the module 10 to a bottom mating portion of another support module. For example, in one preferred embodiment, upon insertion of the top mating portion 36 into a cavity of another support module, the top mating apertures 44A, 44B may be aligned with vertical coupling apertures 34A, 34B in a bottom portion of sidewalls 14A, 14B of the other support module. A fastener may then be inserted into the top mating apertures to further secure the module 10 to another product support module.

Sidewalls 14A, 14B of the present invention allow support modules to be detachably coupled to one another side-by-side. In one preferred embodiment, sidewalls 14A, 14B include one or more raised collars 26A, 26B that may be inserted into aligned coupling apertures of other product support module sidewalls. As shown in FIGS. 1 and 3, in one preferred embodiment, the raised collars 26A, 26B extend from one of the sidewalls 14B and are located at an elevation approximately equal to one-half (½) the height of the sidewall 14, however, other locations and number of collars would work as well. For example, the exact location and number of collars 26A, 26B can vary, depending on the location of coupling apertures in sidewalls of other support modules. Furthermore, raised collars 26A, 26B and are not limited to placement on one particular sidewall. Those skilled in the art will understand that the term "collars" as used herein are structures which may be inserted into an aperture of another support module to allow one support module to be detachable coupled to another support module.

Sidewalls 14A, 14B and collars 26A, 26B may be constructed using a molded polymer material or stamped metal. Preferably, the collars 26A, 26B may be formed integrally with the manufacture of sidewalls 14A, 14B. Alternatively, the collars 26A, 26B may be mounted with a bore provided in the sidewalls 14A, 14B and press fit therein or include a flange having mounting holes to receive mounting screws. Other methods of attachment such as adhesives, suction-type mounting devices and other fastening systems know in art are contemplated and fall within the scope of the present invention.

In one preferred embodiment, as shown in FIG. 1, one of the sidewalls 14A is configured to include receiving apertures 24A, 24B and the other sidewall 14B is configured to include the raised collars 26A, 26B. In other preferred embodiments, both a receiving aperture and raised collar are provided on the same sidewall. Preferably, each aperture is adapted to receive and secure a collar of a sidewall from another support module. For example, in one preferred embodiment, at least one aperture included in a sidewall is adapted to receive a collar of another module, such that, by aligning and pressing the collar into the aperture, two support modules become detachably coupled to one another side by side. Preferably, one or more collars of the support module 10 are press fit into one or more apertures, respectively.

Figure 6:
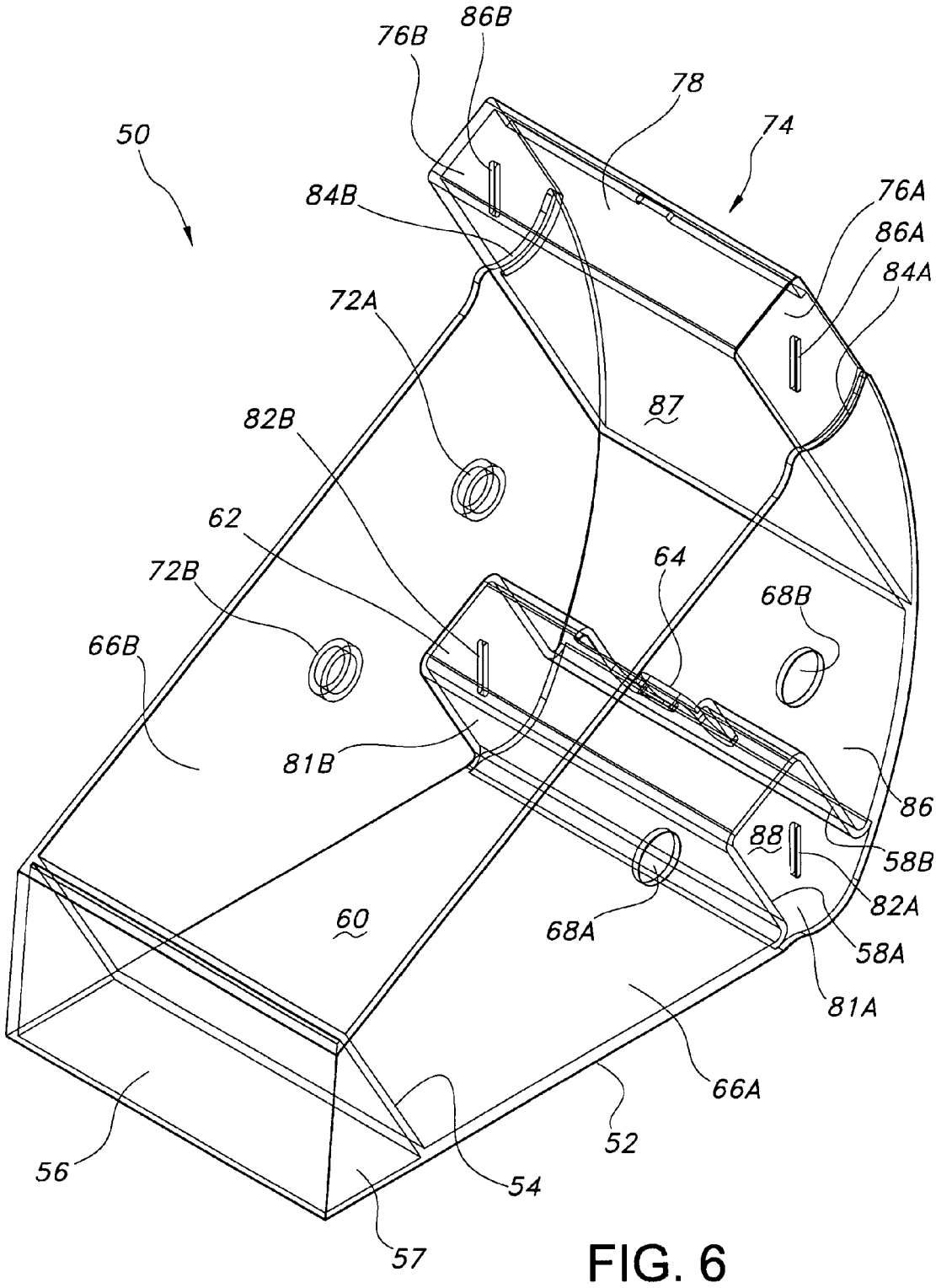
FIG. 6 is a perspective showing of a second product support module of the present invention.
Figure 7:
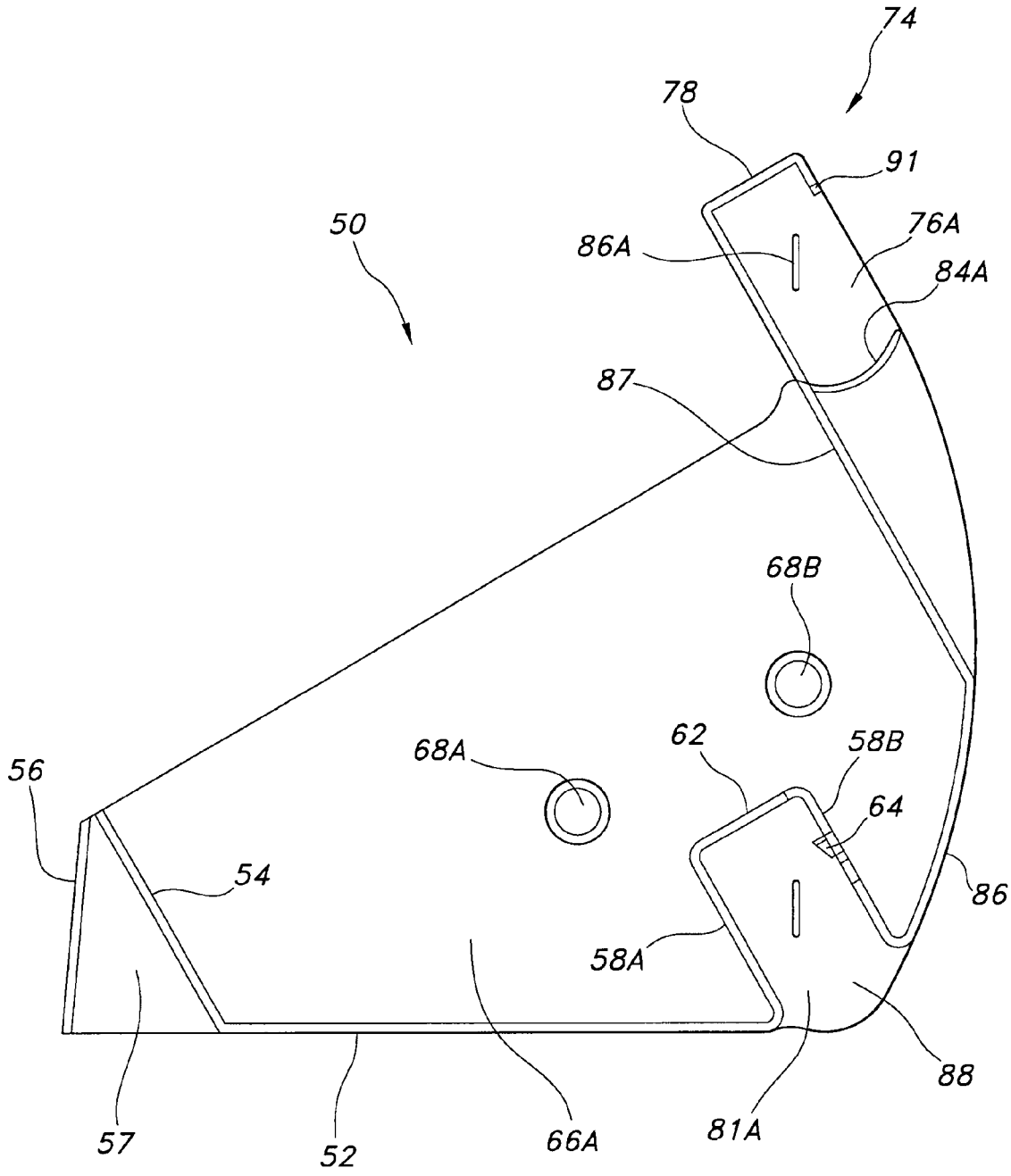
FIG. 7 is a side view of the second product support module of FIG. 6.

Referring now to FIG. 6, a second product support module 50 according to the present invention is disclosed. FIG. 7 is a side view of the second product support module 50. As shown in FIGS. 6 and 7, the product support module 50 includes a frame 52 having a front portion 54, a front wall 56, a support surface 60, a back wall 86, and first and second bottom walls 58A, 58B. The first and second bottom walls 58A, 58B are connected together via a top wall 62 and form a bottom mating portion, such as a cavity 88, that may be used to operatively couple other support modules to the product support module 50. The second product support module 52 can be made from a variety of processes and materials, as for example, molded transparent plastic, stamped materials or combinations thereof, and has a profile substantially similar to that of the first product support module 10.

Figure 8:
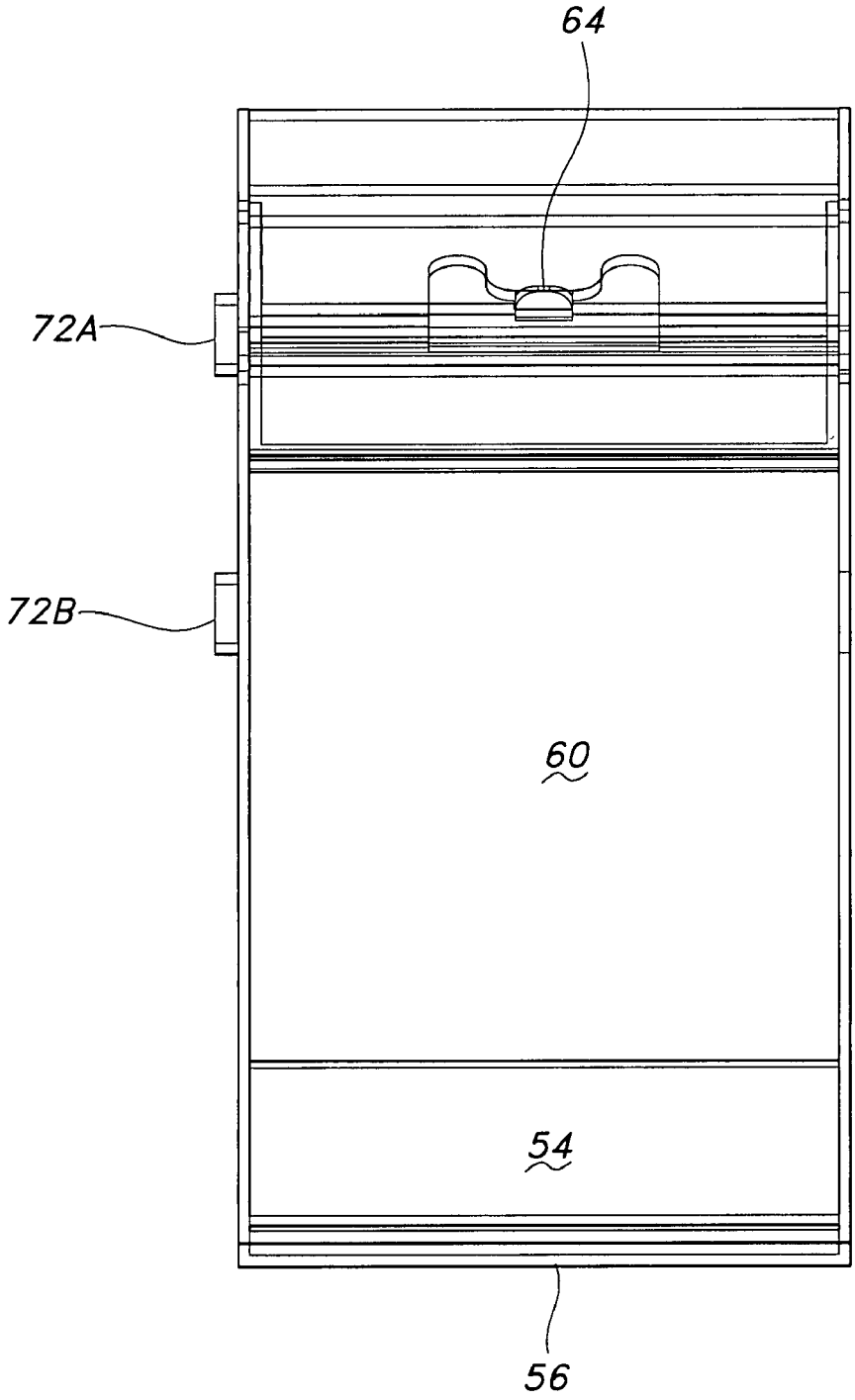
FIG. 8 is a top view of the second product support module of FIG. 6.

The support surface 60 of the frame 52 provides support for both packaged confectionary products and unpackaged miscellaneous items, such as loose hard candy. In one preferred embodiment, as shown in FIGS. 6 and 8, the support surface 60 forms a bottom of the module 50 and is generally planar and continuous in shape.

Referring again to FIGS. 6 and 7, the front portion 54 of the frame 52 is a dispensing area that facilitates removal of retail products from the support module 50. As shown in FIG. 7. the front portion 54 extends in an upward direction away from the support surface 60. In one preferred embodiment, the front portion 54 of the frame 52 extends away from the support surface 60 at approximately a one-hundred and twenty-five (125) degree angle. The front portion 54, however, is not limited to extending at one-hundred and twenty-five (125) degrees and may be positioned at other advantageous angles in the support module 50.

In one preferred embodiment, as shown in FIGS. 6 and 7, extending downward from the top of the front portion 54 of the frame 52 at approximately a ninety (90) degree angle to the support surface 60 is the front wall 56. The front wall 56, however, is not limited to extend downward at a ninety (90) degree angle to the support surface and may extend downward at other advantageous angles to the support surface 60. In some preferred embodiments, the front wall 29 is formed of transparent plastic to allow clear viewing of the product supported in the module. For example, in one preferred embodiment, the front wall 56 and front portion 54 of the frame 52 form a cavity 57 wherein indicia for the product is displayed.

Preferably, the first and second back walls 58A, 58B of the frame 52 are attached to the support surface 60 at an angle substantially parallel to the front portion 54 of the frame 52 and extend upward and away from the support surface 60. As described previously, the first and second back walls 58A, 58B are connected via a perpendicular top wall 62 to form a second cavity 88. In one preferred embodiment, the second cavity 88 formed is of dimensions suitable to securely receive a top mating portion of another support module. As shown in FIGS. 6, 7 and 8, in one preferred embodiment, the second bottom wall 58B also includes a flexible locking mechanism 64 that is attached to an inner side of the second bottom wall 58B and is preferably of a thickness slightly greater than the bottom wall 58B. In some preferred embodiments, stiffeners (not shown) are attached perpendicular to the bottom walls 58A, 58B to facilitate flexing of the locking mechanism 64. The flexible locking mechanism 64 is used to operatively couple and detach the top mating portion of another product support module to the support module 50. The techniques used to detachably couple the top mating portion of support modules to the support module 50 are similar to those discussed in connection with the first product support module 10 and are discussed in connection with FIGS. 9, 10 and 11.

As shown in FIGS. 6 and 7, the support module 50 includes sidewalls 66A, 66B that are attached perpendicular to the frame 52 and extend upward from the support surface 60. In one preferred embodiment, the sidewalls 66A, 66B are made of transparent plastic and are adapted to form sidewalls in each cavity 57, 88 of the module 50. In one preferred embodiment, the sidewalls 66A, 66B are formed as part of the frame 12. In other preferred embodiments, the sidewalls 66A, 66B are separately made and attached to the frame 12 using an adhesive or a weld.

In one preferred embodiment, as shown in FIG. 6, a back portion 81A, 81B of the sidewalls 66A, 66B include one or more oval apertures 82A, 82B that may be adapted to receive a fastener capable of securing the sidewalls 14A, 14B to a top mating portion of another support module.

The support module 50 includes a top mating portion 74 that may be operatively coupled to other product support modules. The top mating portion 74 includes a top wall 78 that is coupled to perpendicular top sidewalls 76A, 76B that extend in a downward direction away from the top wall 78, and a top front surface 87 that is attached to the back wall 86 of the frame 52. In one preferred embodiment, the top sidewalls 76A, 76B are attached to a top portion 84A, 84B of the sidewalls 66A, 66B of the frame 52 using fasteners. In another embodiment, the top sidewalls 76A, 76B are molded onto an interior side of the top portion 84A, 84B of the sidewalls 76A, 76B. The top portion 74 of the support module 50 may be inserted into a cavity of another support module and, according to the present invention, be detachably coupled to another support module.

Figure 9:
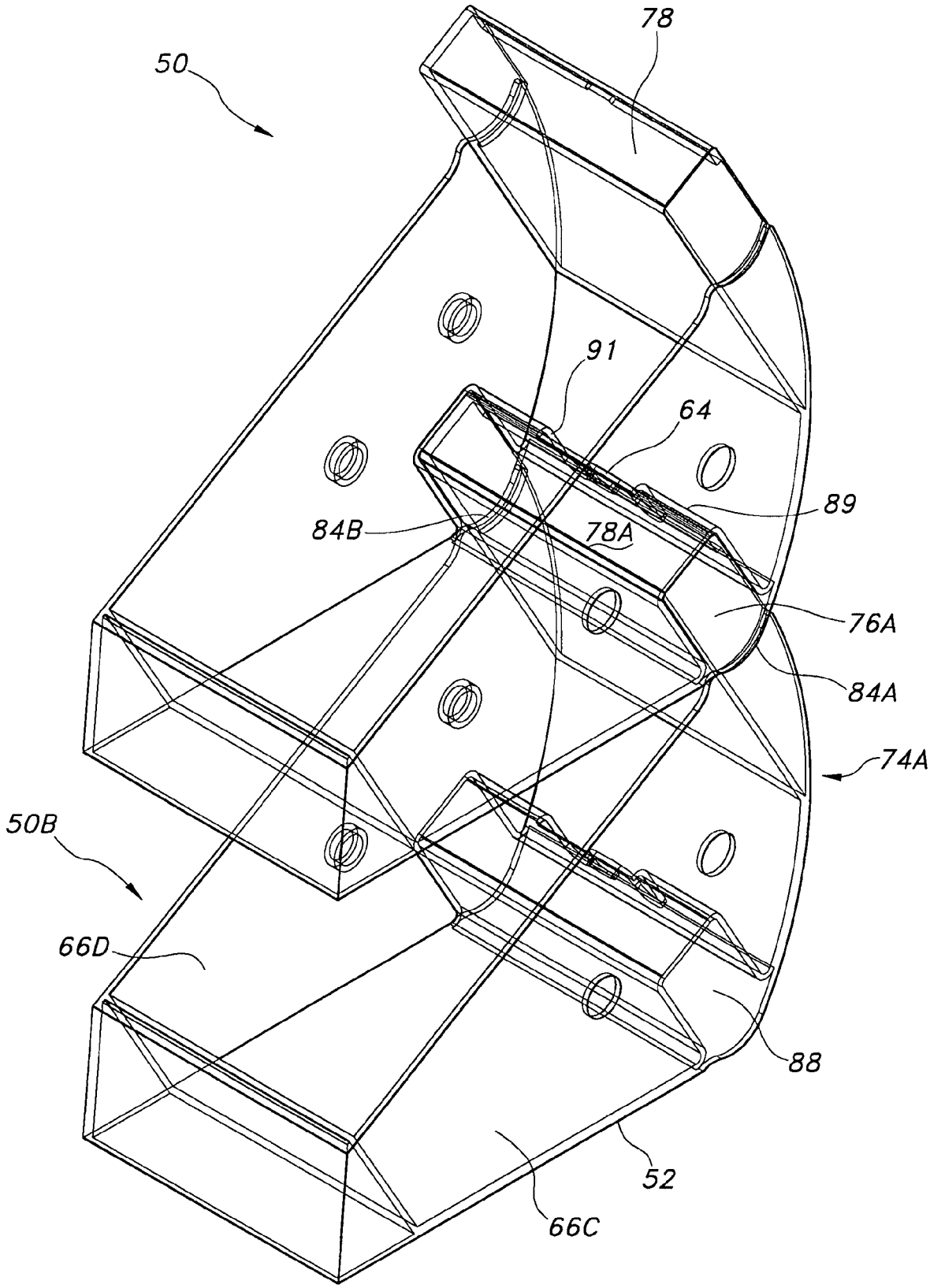
FIG. 9 is a perspective showing of a plurality of second product support modules coupled together.

Referring now to FIG. 9, two second support modules 50, 50B vertically coupled to one another are shown. As shown in FIG. 9 and also in FIG. 4, a top portion 74A of the support module 10B is inserted into the cavity 88 of the module 50. As the top portion 74A is moved into the cavity 88 and toward the locking mechanism 64, the locking mechanism 64 of the support module 50 flexes away from a top wall 78A of the module 50B. Once the top wall 78A moves further into the cavity 88 and over the locking mechanism 64, the locking mechanism 64 flexes away from a back flange 89 attached to the top wall 78A and engages a notch 91 positioned on the back flange 89, thereby locking and operatively coupling the support modules 50, 50B. In one preferred embodiment, as shown in FIG. 9, the tops 84A, 84B of sidewalls 66C, 66D may prevent further insertion of the top portion 74A into the cavity 88 and may provide support for the support module 50.

Figure 10:
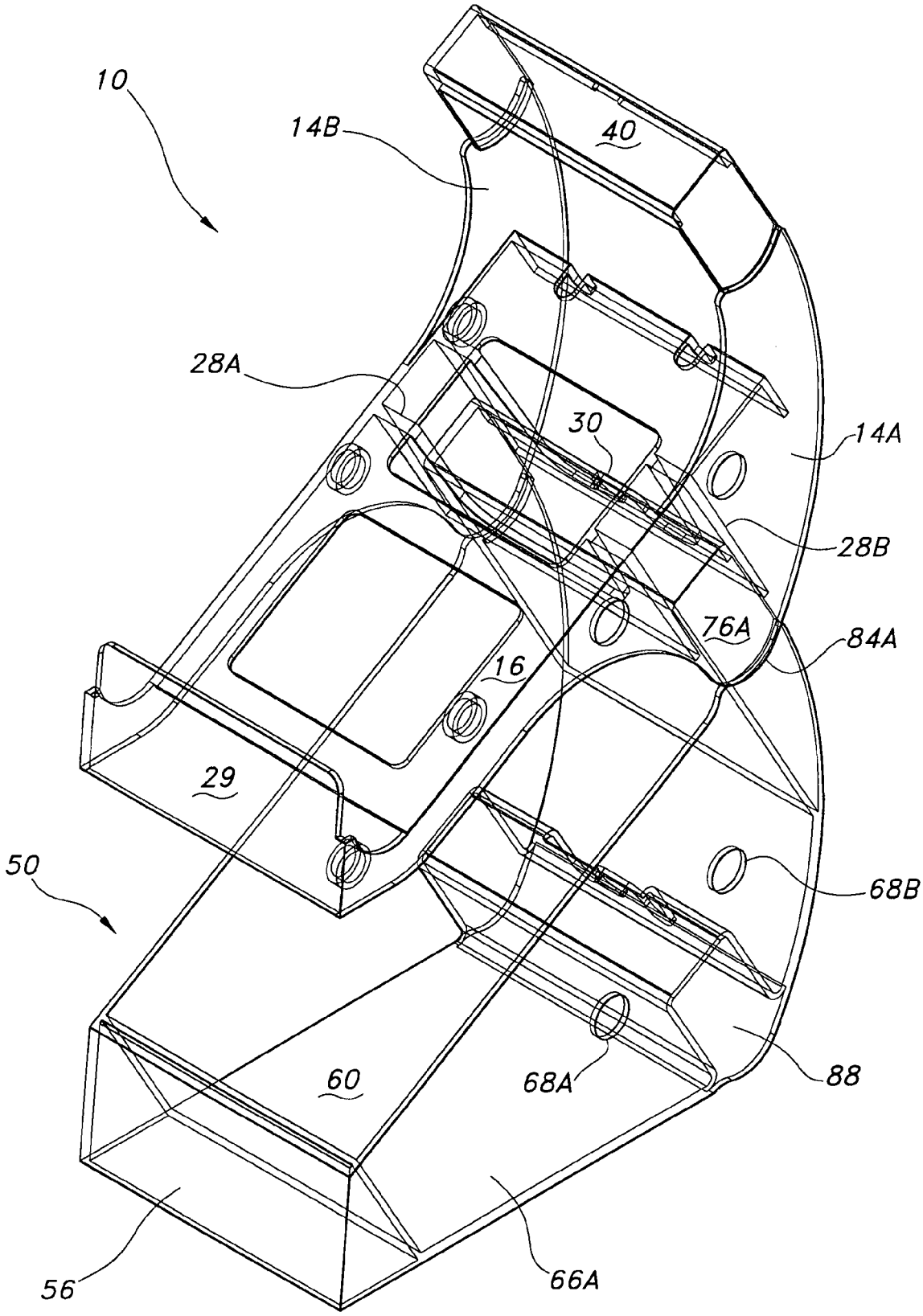
FIG. 10 is a perspective showing of a first and a second product support module coupled together.
Figure 11:
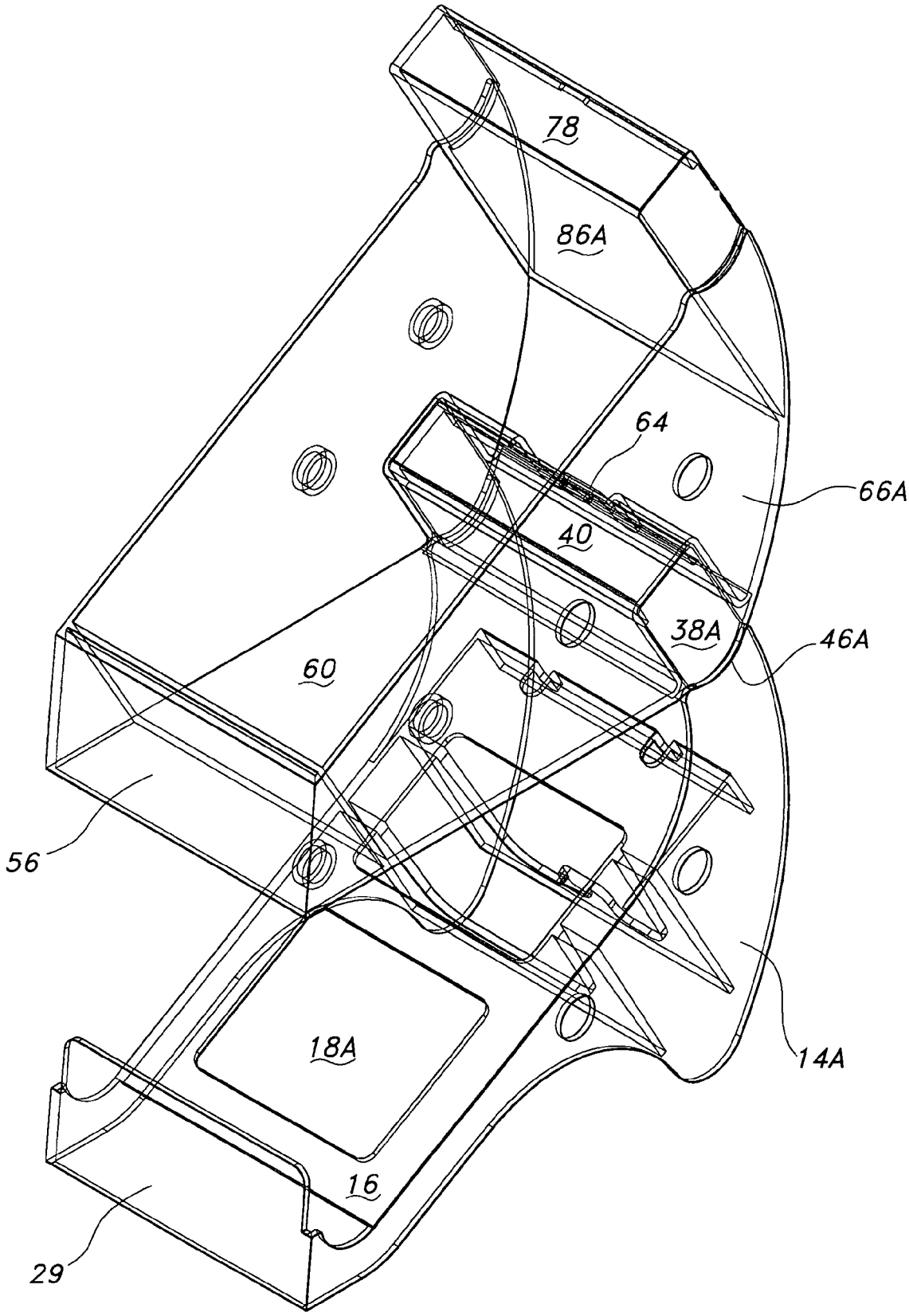
FIG. 11 is an alternative configuration of a first and second product support module coupled together.

Various product support modules of the present invention may be vertically coupled together. For example, FIG. 10 shows an example of the first support module 10 vertically coupled to the second support module 50. The techniques used to vertically couple various product support modules are substantially the same as discussed in connection with FIGS. 5 and 9. For example, as shown in FIG. 10, the top mating portion 74 of the second support module 50 may be inserted into the cavity 20 of the first support module 50. As the top mating portion 74 is moved into the cavity 20 of the first support module 10 and toward the locking mechanism 30, the locking mechanism 30 of the support module 10 flexes away from the top wall 78 of the module 50. Upon movement of the top wall 78 further into the cavity 20 and over the locking mechanism 30, the locking mechanism 30 flexes away from the back flange 17 attached to the top wall 78 and engages the notch 19 positioned on the back flange 17, thereby locking and operatively coupling the support modules 10, 50 together. The tops 84A, 84B of the sidewalls 66A, 66B may prevent further insertion of the top mating portion 74 into the cavity 20 and may provide support for the support module 10. FIG. 11 shows an alternative vertical coupling of the second product support module to the first product support module according to another preferred embodiment. As shown in FIG. 11, the top mating portion 36 of the first support module 10 is inserted into the bottom mating portion, e.g., the cavity 88, in a locking relationship.

Referring again to FIGS. 6 and 7, in one preferred embodiment, the top sidewalls 76A, 76B include top coupling apertures 86A, 86B that may be used to further secure the top mating portion 74 of the module 50 to a bottom mating portion of another support module. For example, in one preferred embodiment, upon insertion of the top mating portion 74 into a cavity of another support module, top coupling apertures 86A, 86B in top sidewalls 76A, 76B may be aligned with apertures 82A, 82B in a bottom portion of sidewalls 66A, 66B of another support module. Fasteners may then be inserted between the apertures to further fasten and detachably couple one product support module to another product support module.

Sidewalls 66A, 66B of the product support module 50 also allow support modules to be detachably coupled to one another side-by-side. As shown in FIGS. 6 and 8, in one preferred embodiment, sidewalls 66A, 66B include one or more raised collars 72A, 72B that may be inserted into corresponding apertures of other product support module sidewalls and allow support modules to be operatively coupled side-by-side. Similar to the first product support module 10, as shown in FIGS. 1 and 3, in one preferred embodiment, the raised collars 66A, 66B extend from one of the sidewalls 66B and are located at an elevation approximately equal to one-half (½) the height of the sidewall 66B, however, other locations and number of collars would work as well. For example, the exact location and number of collars 66A, 66B can vary, depending on the location of receiving apertures in sidewalls of other support modules. Furthermore, raised collars 66A, 66B and are not limited to placement on one particular sidewall.

Similar to collars 26A, 26B disclosed in connection with the first support module 10, the collars 72A, 72B of the second support module 50 may be integrally formed as part of one or both sidewalls 66A, 66B or attached to one or more sidewalls 66A, 66B of the module 50. Preferably, the sidewalls 66A, 66B and collars 72A, 72B are constructed using a molded transparent polymer material and are formed integrally with the manufacture of sidewalls 66A, 66B. In some embodiment, the collars 72A, 72B are mounted with a bore provided in the sidewalls 66A, 66B and press fit therein or include a flange having mounting holes to receive mounting screws. Other methods of attachment such as adhesives, suction-type mounting devices and other fastening systems know in art are contemplated and fall within the scope of the present invention.

As shown in FIGS. 6 and 7, in one preferred embodiment, one of the sidewalls 66A is configured to include receiving apertures 68A, 68B and the other sidewall 66B is configured to include the raised collars 72A, 72B. In other preferred embodiments, both a receiving aperture and raised collar are provided on the same sidewall. Preferably, each aperture is adapted to receive and secure a collar of a sidewall from another support module.

For example, in one preferred embodiment, at least one aperture included in a sidewall is adapted to receive a collar of another module, such that, by aligning and pressing fitting the collar into the aperture, two support modules become operatively coupled to one another side by side. Preferably, a plurality of collars located on a sidewall are press fit into receiving apertures of another support module to secure the modules together side-by-side.

Figure 12:
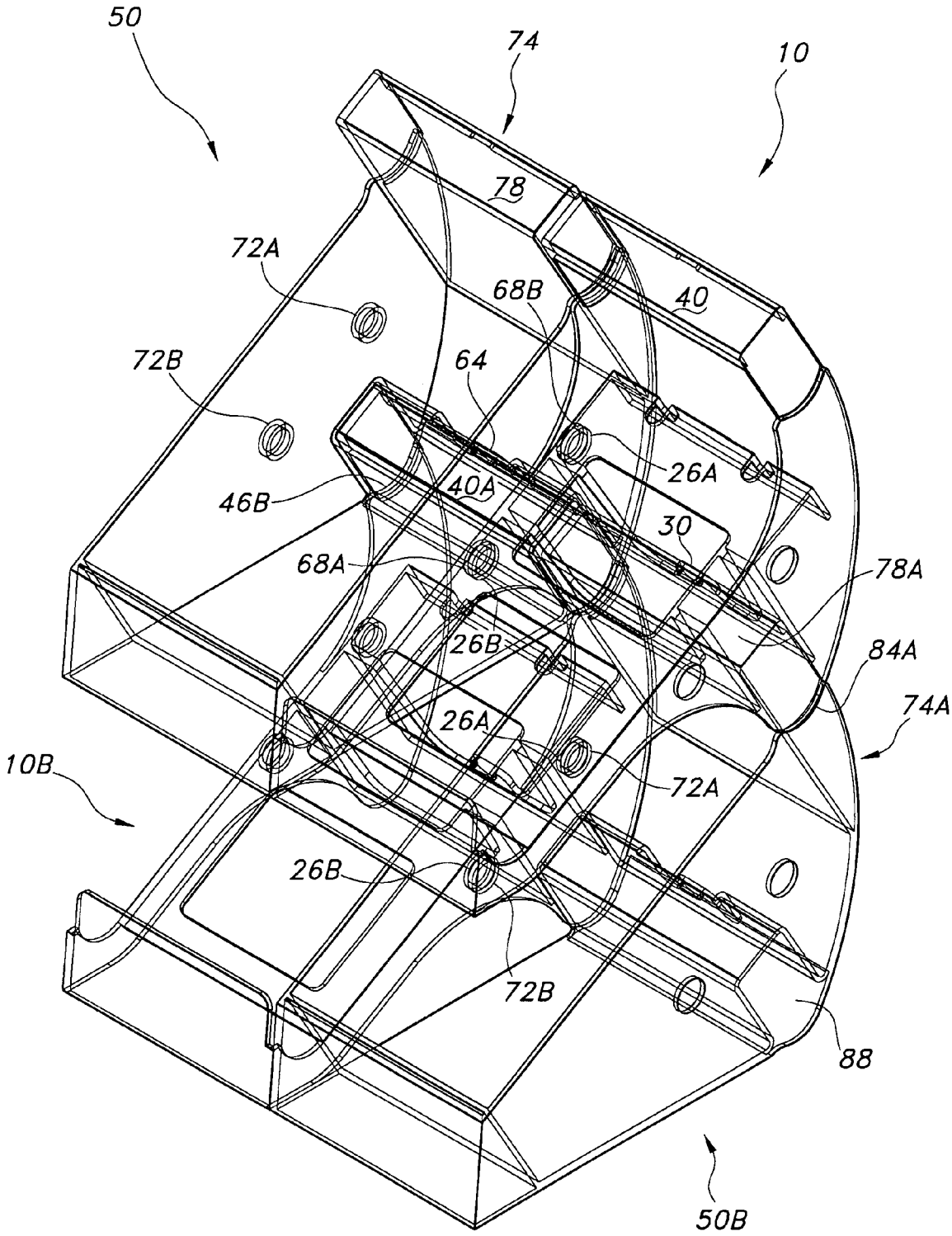
FIG. 12 is a perspective showing a plurality of first and second product support modules coupled together.

Various types of configurations may be assembled using the support modules 10, 50 of the present invention. For example, referring now to FIG. 12, four support modules 10, 10B, 50 and 50B coupled vertically and side-by-side are disclosed. As shown in FIG. 12, support modules 10B and 50B may be operatively coupled by press fitting collars 72A, 72B into receiving apertures 26A, 26B, respectively. Support modules 50 and 10 also may be operatively coupled side-by-side using each modules respective collars and apertures. As shown in FIG. 12, support modules 50 and 10 also may be vertically coupled to support modules 10B and 50B, respectively, by inserting top mating portions of each module 10B, 50B into bottom mating portions 88, 20 of modules 50 and 10, respectively, and activating each modules 50, 10 locking mechanism 64, 30 as described previously. Although only four support modules are shown in FIG. 12, any number of support modules may be configured side-by-side or coupled vertically.

It thus may be appreciated that the display and dispensing modules of the present invention provides the ability to arrange and dispense various different configurations of products. Moreover, the transparency of the product support modules of the present invention allow the stand to include advertising indicia thereby obviating the need for additional advertising on the display stand and allowing a completely configurable display stand to be used universally with different types of products.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A modular display stand for displaying and dispensing retail articles comprising:

a plurality of product support modules for detachably coupling to one another in at least a vertical orientation;

each support module including a pair of spaced apart sidewalls supporting therebetween a retail article support surface arranged at an incline with respect to said vertical orientation, said support surface including a pair of spaced apart bottom walls extending generally perpendicularly from said support surface and defining therebetween a cavity and a top mating portion extending from said sidewalls at a direction perpendicular to said incline, said top mating portion of one module of said plurality being insertable into said cavity of another module of said plurality in said direction perpendicular to said incline;

wherein each said support module includes a locking mechanism for detachably securing one said support module to another said support module.

2. A modular display stand of claim 1 wherein said locking mechanism includes a tab formed on one of said bottom walls.

3. A modular display stand of claim 2 wherein said locking mechanism further includes a flange on said top mating portion, said flange having a notch therein for receipt of said tab of said bottom wall.

4. A modular display stand of claim 1 wherein said plurality of product support modules are formed of transparent polymeric material.

5. The modular display stand of claim 1, wherein each of the sidewalls includes stoppers that support said coupled modules.

6. The modular display stand of claim 1 further including a front wall for displaying indicia of a product dispensable from the support module.

7. A modular display stand for displaying and dispensing retail articles comprising:

a plurality of product support modules for detachably coupling to one another in at least a vertical orientation;

each support module including a pair of spaced apart sidewalls supporting therebetween a retail article support surface arranged at an incline with respect to said vertical orientation, said support surface including a pair of spaced apart bottom walls extending generally perpendicularly from said support surface and defining therebetween a cavity and a top mating portion extending from said sidewalls at a direction perpendicular to said incline, said top mating portion of one module of said plurality being insertable into said cavity of another module of said plurality in said direction perpendicular to said incline;

wherein said plurality of product support modules are further detachably coupled side-by-side.

8. A modular display stand of claim 7 wherein said sidewalls include interfitting structure to detachably couple one sidewall of one said product support module to the other sidewall of another said product support module.

9. A modular display stand of claim 8 wherein said interfitting structure includes one sidewall having an aperture and the other said side wall having an external collar, said aperture of one said product support module receiving said collar of another said product support member in press-fit fashion.

* * * * *